US006806242B2

(12) United States Patent
Shirahama et al.

(10) Patent No.: US 6,806,242 B2
(45) Date of Patent: Oct. 19, 2004

(54) LOW-FRICTION SLIDING MECHANISM

(75) Inventors: Shinichi Shirahama, Kawasaki (JP); Shozaburo Konishi, Yokohama (JP); Makoto Kano, Yokohama (JP); Yoshiteru Yasuda, Yokohama (JP); Tokio Sakane, Yokohama (JP)

(73) Assignees: Nissan Motor Co., Ltd., Yokohama (JP); Nippon Oil Corporation, Tokyo (JP)

( * ) Notice: Subject to any disclaimer, the term of this patent is extended or adjusted under 35 U.S.C. 154(b) by 0 days.

(21) Appl. No.: 10/355,099

(22) Filed: Jan. 31, 2003

(65) Prior Publication Data

US 2003/0162672 A1 Aug. 28, 2003

(30) Foreign Application Priority Data

Feb. 22, 2002 (JP) ..... 2002-045576

(51) Int. Cl.[7] ..... C10M 129/70; C10M 141/06

(52) U.S. Cl. ..... 508/291; 508/371; 508/486; 508/487; 508/545; 123/1 A

(58) Field of Search ..... 508/487, 291

(56) References Cited

U.S. PATENT DOCUMENTS

| | | | | |
|---|---|---|---|---|
| 4,538,929 | A | 9/1985 | Ehrentraut et al. | |
| 4,554,208 | A | 11/1985 | MacIver et al. | |
| 4,755,426 | A | 7/1988 | Kokai et al. | |
| 4,783,368 | A | 11/1988 | Yamamoto et al. | |
| 4,834,400 | A | 5/1989 | Lebeck | |
| 4,974,498 | A | 12/1990 | Lemelson | |
| 5,077,990 | A | 1/1992 | Plath | |
| 5,190,824 | A | 3/1993 | Itoh | |
| 5,205,188 | A | 4/1993 | Repenning et al. | |
| 5,237,967 | A | 8/1993 | Willermet et al. | |
| 5,249,554 | A | 10/1993 | Tamor et al. | |
| 5,466,431 | A | 11/1995 | Dorfman et al. | |
| 5,630,953 | A | 5/1997 | Klink | |
| 5,735,769 | A | 4/1998 | Takemura et al. | |
| 5,843,571 | A | 12/1998 | Sho | |
| 5,851,962 | A | * 12/1998 | Kaga | 508/162 |
| 6,059,460 | A | 5/2000 | Ono et al. | |
| 6,095,690 | A | 8/2000 | Niegel et al. | |
| 6,237,441 | B1 | 5/2001 | Nishioka et al. | |
| 6,255,262 | B1 | * 7/2001 | Keenan et al. | 508/486 |
| 6,333,298 | B1 | * 12/2001 | Waddoups et al. | 508/373 |
| 6,523,456 | B1 | 2/2003 | Kobayashi et al. | |
| 6,524,212 | B2 | 2/2003 | Ushijima et al. | |
| 2002/0090155 | A1 | 7/2002 | Ushijima et al. | |
| 2002/0148430 | A1 | 10/2002 | Kano et al. | |
| 2003/0128903 | A1 | 7/2003 | Yasuda et al. | |

FOREIGN PATENT DOCUMENTS

| | | | |
|---|---|---|---|
| EP | 0 529 327 | A1 | 3/1993 |
| EP | 0 661 470 | A2 | 7/1995 |
| EP | 0 731 190 | B1 | 5/1999 |
| JP | 6-294307 | A | 10/1994 |
| JP | 7-090553 | A | 4/1995 |
| JP | 2000-504089 | A | 4/2000 |
| WO | WO 92/02602 | A1 | 2/1992 |
| WO | WO 93/21289 | A1 | 10/1993 |
| WO | WO 01/05917 | A1 | 1/2001 |

OTHER PUBLICATIONS

Kano et al., "Friction Property of Hard Carbon film in Engine Oil", Japan Tribology Congress 1999, 5, Tokyo, Proceeding pp. 11 and 12.

Kano et al, "The Effect of ZDDP and MODTC Additives on Friction Properties of DLC and Steel Cam Follower in Engine Oil", Abstracts of Papers from 2$^{nd}$ World Tribology Congress, Sep. 3–7, 2001, p. 342.

Japanese Industrial Standard, "Carbon Steels for Machine Structural Use", Japanese Standards Association, JIS G 4051, 1979, pp. 1–10.

Japanese Industrial Standard, "Chromium Steels", Japanese Standards Association, JIS G 4104, 1979, pp. 1–9.

Japanese Industrial Standard, "Chromium Molybdenum Steels", Japanese Standards Association, JIS G 4105, 1979, pp. 1–11.

"Standard Test Method for Separation of Representative Aromatics and Nonaromatics Fractions of High–Boiling Oils by Elution Chromatography", ASTM Designation: D 2549–91 (Reapproved 1995), pp. 895–900.

International Standard, "Petroleum products—Determination of Base Number—Perchloric Acid Potentiometric Titration Method", ISO 3771, Second Edition Aug. 15, 1994, pp. 1–8.

Database WPI, Week 200065, Nov. 28, 2000, Derwent Publications, Ltd., AN 2000640583, XP002240184, JP 2000–327484, Nov. 28, 2000.

Japanese Industrial Standard, "Vickers Hardness Test—Test Method", JIS Z 2244, 1998, pp. 1–8 (with translation).

Japanese Industrial Standard, "High Carbon Chromium Bearing Steels", JIS G 4805, 1999, pp. 1–31 (with translation).

Japanese Industrial Standard, "Surface Roughness—Definitions and Designation", JIS B 0601, 1994, pp. 1–25 (with translation).

Meyer–Rässler, "Neuartige Laufflächen–Schutzverfahren für Kolben von Verbrennungsmotoren," VDI–Zeitschrift, 1942, vol. 86, No. 15/16, pp. 245 to 247.

(List continued on next page.)

*Primary Examiner*—Eileen M. McAvoy
(74) *Attorney, Agent, or Firm*—Foley & Lardner LLP

(57) ABSTRACT

A low-friction sliding mechanism of the present invention comprises first and second sliding members slidable relative to each other at sliding surfaces thereof and a lubricant being applied to the sliding surfaces of the first and second sliding members. The first and second members are made of a diamond-like carbon material and an iron-based material, respectively, and the lubricant comprises a base oil and at least one of an ashless fatty-ester friction modifier and an ashless aliphatic-amine friction modifier.

10 Claims, No Drawings

OTHER PUBLICATIONS

Engine Oil Viscosity Classification—SAE J300 revised Apr. 1997, p. 133.

Dr. Marx, "Surfaces and Contact Mechanics", XP–002233233, Google, Retrieved from the Internet, Mar. 3, 2003, pp. 1–18.

Patent Abstracts of Japan, vol. 2000,. No. 09, Oct. 13, 2000, JP 2000–170768, Jun. 20, 2000.

Patent Abstracts of Japan, vol. 2000, No. 01, Jan. 31, 2000, JP 11–287329, Oct. 19, 1999.

Patent Abstracts of Japan, vol. 1996, No. 09, Sep. 30, 1996, JP 08–128448, May 21, 1996.

API Motor Oil Guide, Which Oil is Right for You, American Petroleum Institute, Copyright 2002.

"Assessment of $2^{nd}$ to $5^{th}$ Order Irregularities of Surface Configuration by Means of Sections of Surfaces Definitions Relating to Reference System and Dimensions," DIN 4762, UDC 621–288:001,4 (Aug. 1960), pp. 1–4.

"Geometrical Product Specifications (GPS)—Surface Texture: Profile Method—Terms, Definitions and Surface Texture Parameters," International Standard, ISO 4287, TC 213 (1997), pp. 1–25.

* cited by examiner

LOW-FRICTION SLIDING MECHANISM

BACKGROUND OF THE INVENTION

The present invention relates to a sliding mechanism having excellent low-friction characteristics, particularly of the kind for use in an internal combustion engine.

Global environmental problems, such as global warming and ozone layer destruction, have been coming to the fore. It is said that the global warming is significantly effected by $CO_2$ emission. The reduction of $CO_2$ emission, notably the setting of $CO_2$ emission standards, has therefore become a big concern to each country.

One of challenges to reduce $CO_2$ emission is to improve vehicle fuel efficiency, and the sliding mechanism of a vehicle engine is largely involved in the improvements in vehicle fuel efficiency. There are the following approaches to improving the vehicle efficiency in terms of the sliding mechanism: (1) to provide a higher abrasion resistance and a lower friction coefficient for sliding members of the sliding mechanism, which are generally made of steel materials in the earlier technology, even under extreme conditions of abrasion and friction; (2) to decrease the viscosity of a lubricant in the sliding mechanism, thereby reducing viscous resistance in hydrodynamic lubrication regions and agitation resistance in the engine; and (3) to mix a suitable friction modifier and other additives into the lubricant so as to reduce friction losses under the conditions of mixed lubrication and boundary lubrication. Heretofore, researches have been made on an organomolybdenum compound, such as molybdenum dithiocarbamate (MoDTC) or molybdenum dithiophosphate (MoDTP), for use as the friction modifier and show that the lubricant containing such an organomolybdenum compound is effective in reducing friction when used for the steel sliding members.

SUMMARY OF THE INVENTION

Various hard coating materials have been recently applied to the sliding member of the sliding mechanism in order to attain high abrasion resistance and a low friction coefficient. In particular, a diamond-like carbon (DLC) material is expected to be useful as a coating material for the sliding member, because the DLC material provides a lower friction coefficient in the air than that of another abrasion-resistant hard coating material (such as TiN or CrN).

However, the DLC material does not provide such a low friction coefficient in the sliding mechanism in the presence of lubricant (as disclosed in Japan Tribology Congress 1999. 5, Tokyo, Proceeding Page 11–12, KANO et.al.). The friction coefficient of the DLC material cannot be lowered to a sufficient degree even when used in combination with the lubricant containing the above organomolybdenum compound (as disclosed in World Tribology Congress 2001. 9, Vienna, Proceeding Page 342, KANO et.al.).

It is therefore an object of the present invention to provide a sliding mechanism that can attain excellent low-friction characteristics and high abrasion resistance by the combined use of a diamond-like carbon material and a lubricant, so that the sliding mechanism, when used in a vehicle engine, shows more improvements in vehicle fuel efficiency than that of the earlier technology.

According to an aspect of the present invention, there is provided a low-friction sliding mechanism, comprising: first and second sliding members slidable relative to each other at sliding surfaces thereof, the first sliding member being made of a diamond-like carbon material, the second sliding member being made of an iron-based material; and a lubricant applied to the sliding surfaces of the first and second sliding members and comprising at least one of an ashless fatty-ester friction modifier and an ashless aliphatic-amine friction modifier.

DESCRIPTION OF THE EMBODIMENTS

The present invention will be described below in detail. In the following description, all percentages (%) are by mass unless otherwise specified.

A sliding mechanism according to the present invention comprises first and second sliding members slidable relative to each other at sliding surfaces thereof and a lubricant applied to the sliding surfaces of the first and second sliding members.

The first sliding member is made of a diamond-like carbon (DLC) material. The DLC material is an amorphous form of carbon in which carbon exists in both $sp^2$ and $sp^3$ hybridizations so as to form a composite structure of graphite and diamond. Specific examples of the DLC material usable in the present invention include hydrogen-free amorphous carbon (a-C) consisting of carbon, hydrogen-containing amorphous carbon (a-C:H) and metal carbide (MeC) containing a metal element of titanium (Ti) or Molybdenum (Mo). In the present invention, especially preferred is hydrogen-free amorphous carbon (a-C) for significant reduction in friction.

The second sliding member is made of an iron-based material. Specific examples of the iron-based material usable in the present invention include: low-alloy chilled cast iron; carburized steel based on e.g. SCM420 (according to JIS G4105) and SCr420 (according to JIS G4104); heat-treated carbon steel based on e.g. S40C (according to JIS G 4051); and mixtures of two or more thereof.

Each of the first and second sliding members preferably has at the sliding surface thereof an arithmetic mean surface roughness Ra of 0.1 $\mu$m or less for stable sliding contact. When the surface roughness Ra exceeds 0.1 $\mu$m, there arises a possibility of localized scuffing in the sliding surface so that the friction coefficient between the sliding surfaces becomes largely increased.

Further, the first sliding member preferably has a micro Vickers hardness Hv of 1,000 to 3,500 (with a 1 kg load applied) at the sliding surface thereof and a thickness t of 0.3 to 2.0 $\mu$m, and the second sliding member preferably has a Rockwell hardness HRC of 45 to 60 on C scale at the sliding surface thereof. This makes it possible to maintain the durability of the first and second sliding members even under the sliding condition of a high surface pressure of about 700 MPa (that corresponds to the pressure condition of an engine cam mechanism). When the micro Vickers hardness Hv and the thickness t are less than 1,000 and 0.3 $\mu$m, respectively, the first sliding member tends to wear out. On the other hand, when the micro Vickers hardness Hv and the thickness t exceed 3,500 and 2.0 $\mu$m, respectively, the first sliding member tends to flake off. When the Rockwell hardness HRC is less than 45, the second sliding member tends to buckle under a high surface pressure.

The lubricant comprises a base oil and at least one of an ashless fatty-ester friction modifier and an ashless aliphatic-amine friction modifier.

The base oil is not particularly limited, and can be any oil compounds commonly used for a lubricant, such as mineral oil or synthetic oil.

Specific examples of the mineral oil include oil compounds prepared by extracting a lubricant fraction from petroleum by atmospheric or reduced-pressure distillation and then purifying the obtained lubricant fraction by at least one of the following treatments: solvent deasphalting, solvent extraction, hydrogenolysis, solvent dewaxing, hydrotreating and wax isomerization. In the present invention, the mineral oil prepared through hydrogenolysis, hydrotreating and/or wax isomerization is preferably used.

Specific examples of the synthetic oil include: alkylbenzenes, alkylnaphthalenes, polybutenes and hydrides thereof; poly-α-olefins, such as 1-octene oligomer and 1-decene oligomer, and hydrides thereof; diesters, such as ditridecyl glutarate, dioctyl adipate, diisodecyl adipate, ditridecyl adipate and dioctyl sebacate; polyol esters, such as trimethylolpropane caprylate, trimetylolpropane pelargonate, pentaerythritol-2-ethyl hexanoate and pentaerythritol pelargonate; and mixtures thereof. Among these synthetic oil compounds, preferred are poly-α-olefins, such as 1-octene oligomer and 1-decene oligomer and hydrides thereof.

The above-mentioned mineral and synthetic oil compounds may be used alone, or in the form of a mixture of any two or more thereof with no limitation on its mixture ratio.

The aromatic content of the base oil is not particularly restricted. Herein, the aromatic content is defined as the amount of an aromatics fraction determined according to ASTM D2549 "Standard Test Method for Separation of Representative Aromatics and Nonaromatics Fractions of High-Boiling Oils by Elution Chromatography". The aromatics fraction generally includes alkylbenzenes, alkylnaphthalenes, anthracene, phenanthrene and alkylates thereof, condensed-ring compounds having four or more benzeoid rings fused together, and heteroaromatic compounds such as pyridines, quinolines, phenols and naphtols. In the present invention, the aromatic content of the base oil is preferably 15% or less, more preferably 10% or less and most preferably 8% or less. When the aromatic content exceeds 15%, the base oil undesirably deteriorates in oxidation stability. It is noted that the lubricant may be able to produce a high friction reducing effect, even if the aromatic content of the base oil is 2% or less (inclusive of 0%). In such a case, however, there arise a possibility that the lubricant deteriorates in storage stability, e.g., when the fatty-ester friction modifier and/or aliphatic-amine friction modifier is contained in an amount of more than 1%. Thus, the aromatic content of the base oil is preferably adjusted to e.g. 2% or more by adding solvent refining mineral oil, alkylbenzene or the like as needed.

Further, the kinematic viscosity of the base oil is not particularly restricted. The kinematic viscosity of the base oil is preferably 2 $mm^2/s$ or higher, more preferably 3 $mm^2/s$ and, at the same time, is preferably 20 $mm^2/s$ or lower, more preferably 10 $mm^2/s$ or lower, most preferably 8 $mm^2/s$ or lower, as measured at 100° C. so as to be suitable for use in an internal combustion engine. When the kinematic viscosity is 2 $mm^2/s$ or higher, the lubricant can attain a high lubricity by forming a sufficient lubricant film and minimize its boil-off even under the high surface-pressure condition. When the kinematic viscosity is 20 $mm^2/s$ or lower, the lubricant can minimize friction resistance in lubrication regions by decreasing fluid resistance.

The viscosity index of the base oil is not particularly restricted, and is preferably 80 or higher, more preferably 100 or higher, most preferably 120 or higher, so as to be suitable for use in an internal combustion engine. When the base oil has a higher index, the lubricant can not only attain excellent low-temperature viscosity characteristics and but also produce a good friction reducing effect.

The fatty-ester friction modifier and the aliphatic-amine friction modifier are an fatty acid ester and an aliphatic amine having $C_6$–$C_{30}$ straight or branched hydrocarbon chains, preferably $C_8$–$C_{24}$ straight or branched hydrocarbon chains, more preferably $C_{10}$–$C_{20}$ straight or branched hydrocarbon chains, respectively. When the carbon number of the hydrocarbon chain is not within the range of 6 to 30, there arises a possibility that the lubricant may not produce a sufficient friction reducing effect as expected in the present invention.

Specific examples of the $C_6$–$C_3O$ straight or branched hydrocarbon chain usable in the present invention include: alkyl groups, such as hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl; and alkenyl groups, such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl and triacontenyl. The above alkyl and alkenyl groups include all possible isomers.

The fatty acid ester can be exemplified by esters of fatty acids having the above hydrocarbon groups and monofunctional aliphatic alcohols or aliphatic polyols. Specific examples of the fatty acid ester usable in the present invention include glycerol monolate, glycerol diolate, sorbitan monolate and sorbitan diolate.

The aliphatic amine can be exemplified by: aliphatic monoamines, aliphatic polyamines and alkylene oxide adducts thereof; imidazoline compounds; and derivatives thereof. Specific examples of the aliphatic amines usable in the present invention include: aliphatic monoamines and polyamines, such as laurylamine, lauryldiethylamine, lauryldiethanolamine, dodecyldipropanolamine, palmitylamine, stearyltetraethylenepentamine, oleylamine, oleylpropylenediamine, oleyldiethanolamine and N-hydroxyethyloleylimidazolyne; adducts of the above aliphatic amines ($C_6$–$C_{28}$ alkyl or alkenyl amines) with alkylene oxides, such as N,N-dipolyoxyalkylene-N-alkylamines; and acid-modified compounds prepared by reacting the above aliphatic amines with $C_2$–$C_{30}$ monocarboxylic acids (such as fatty acids) or $C_2$–$C_{30}$ polycarboxylic acids (such as oxalic acid, phthalic acid, trimellitic acid and pyromellitic acid) so as to neutralize or amidate the whole or part of the remaining amino and/or imino groups. In the present invention, especially preferred is N,N-dipolyoxyethylene-N-oleylamine.

The amount of the fatty-ester friction modifier and/or the aliphatic-amine friction modifier added in the lubricant is not particularly restricted, and is preferably 0.05 to 3.0%, more preferably 0.1 to 2.0%, most preferably 0.5 to 1.4%, based on the total mass of the lubricant. When the amount of the fatty-ester friction modifier and/or the aliphatic-amine friction modifier is less than 0.05%, there arises a possibility that the lubricant may not produce a sufficient friction reducing effect. When the amount of the fatty-ester friction modifier and/or the aliphatic-amine friction modifier exceeds 3.0%, the lubricant produce a good friction reducing effect but undesirably deteriorates in storage stability and compatibility between and the base oil and the friction modifier to cause precipitations.

Preferably, the lubricant further includes, as an ashless dispersant, polybutenyl succinimide and/or a derivative thereof.

The polybutenyl succinimide usable in the present invention can be exemplified by compounds represented by the following general formulas (1) and (2).

(1)

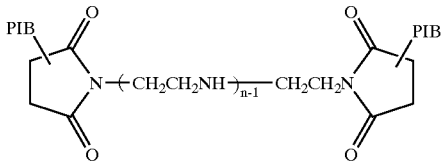

(2)

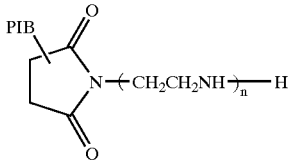

In each of the formulas (1) and (2), PIB represents a polybutenyl group derived from a polybutene, which is prepared by polymerizing high-purity isobutene or a mixture of 1-butene and isobutene in the presence of a boron fluoride catalyst or an aluminum chloride catalyst in such a manner that the polybutene attains a number-average molecular weight of 900 to 3,500, preferably 1,000 to 2,000. When the number-average molecular weight of the polybutene is less than 900, there is a possibility of failing to attain a sufficient detergent effect. When the number-average molecular weight of the polybutene exceeds 3,500, the polybutene undesirably tends to deteriorate in low-temperature fluidity. In the production of polybutenyl succinimide, the polybutene may be used after purified by removing trace amounts of fluorine and chlorine residues, which result from the above polybutene production catalyst, by any suitable treatment, such as adsorption process or washing process. The amount of such fluorine and chlorine residues is preferably controlled to 50 ppm or less, more preferably 10 ppm or less, most preferably 1 ppm or less. Further, n represents an integer of 1 to 5, preferably 2 to 4, so as to attain a good detergent effect.

The production method of polybutenyl succinimide is not particularly restricted. For example, the polybutenyl succinimide can be prepared by reacting an chloride of the above-mentioned polybutene or the polybutene from which fluorine and chlorine residues are removed with maleic anhydride at 100 to 200° C. to form butenyl succinate, and then, reacting the thus-formed butenyl succinate with a polyamine, such as diethylene triamine, triethylene tetramine, tetraethylene pentamine or pentaethylene hexamine.

The derivative of polybutenyl succinimide can be exemplified by boron- and acid-modified compounds obtained by reacting the polybutenyl succinimide of the formulas (1) and (2) with boron compounds or oxygen-containing organic compounds so as to neutralize or amidate the whole or part of the remaining amino and/or imide groups. In the present invention, boron-containing polybutenyl succinimide, especially boron-containing bis(polybutenyl)succinimide, is preferably used. Herein, the content ratio of nitrogen to boron (B/N) by mass in the boron-containing polybutenyl succinimide is usually 0.1 to 3, preferably 0.2 to 1.

The above boron compound can be a boric acid, a borate or a boric acid ester. Specific examples of the boric acid include orthoboric acid, metaboric acid and paraboric acid. Specific examples of the borate include: ammonium salts indlucing ammonium borates, such as ammonium metaborate, ammonium tetraborate, ammonium pentaborate and ammonium octaborate. Specific examples of the boric acid ester include: esters of boric acids and alkylalcohols (preferably $C_1$–$C_6$ alkylalcohols), such as monomethyl borate, dimethyl borate, trimethyl borate, monoethyl borate, diethyl borate, triethyl borate, monopropyl borate, dipropyl borate, tripropyl borate, monobutyl borate, dibutyl borate and tributyl borate.

The above oxygen-containing organic compound can be exemplified by: $C_1$–$C_{30}$ monocarboxylic acids, such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid and eicosanoic acid; $C_2$–$C_{30}$ polycarboxylic acids, such as oxalic acid, phthalic acid, trimellitic acid and pyromellitic acid, and anhydrides and esters thereof; $C_2$–$C_6$ alkylene oxides; and hydroxy(poly) oxyalkylene carbonates.

The amount of the polybutenyl succinimide and/or the derivative thereof added in the lubricant is not particularly restricted, and is preferably 0.1 to 15%, more preferably 1.0 to 12%, based on the total mass of the lubricant. When the amount of the polybutenyl succineimide and/or the derivative thereof is less than 0.1%, there arises a possibility of failing to attain a sufficient detergent effect. It becomes uneconomical when the amount of the polybutenyl succineimide and/or the derivative thereof exceeds 15%. In addition, such a large amount of the polybutenyl succineimide and/or the derivative thereof tends to deteriorate in demulsification ability.

Further, the lubricant preferably includes, as an antioxidant and as an anti-wear agent, zinc dithiophosphate represented by the following general formula (3).

(3)

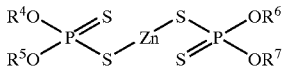

In the general formula (3), $R^4$, $R^5$, $R^6$ and $R^7$ each represent $C_1$–$C_{24}$ hydrocarbon groups. The $C_1$–$C_{24}$ hydrocarbon group is preferably a $C_1$–$C_{24}$ straight-chain or branched-chain alkyl group, a $C_3$–$C_{24}$ straight-chain or branched-chain alkenyl group, a $C_5$–$C_{13}$ cycloalkyl group, a $C_5$–$C_{13}$ straight-chain or branched-chain alkylaryl group, a $C_6$–$C_{18}$ aryl group, a $C_6$–$C_{18}$ straight-chain or branched-chain alkylaryl group or a $C_7$–$C_{19}$ arylalkyl group. The above alkyl group or alkenyl group can be primary, secondary or tertiary. Specific examples of $R^4$, $R^5$, $R^6$ and $R^7$ include: alkyl groups, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl; alkenyl groups, such as propenyl, isopropenyl, butenyl, butadienyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl (oleyl), nonadecenyl, eicosenyl, heneicosenyl, docosenyl, tricosenyl and tetracosenyl; cycloalkyl groups, such as cyclopentyl, cyclohexyl and cycloheptyl; alkylcycloalkyl groups, such as methylcyclopentyl, dimethylcyclopentyl, ethylcyclopentyl, propylcyclopentyl, ethylmethylcyclopentyl, trimethylcyclopentyl, diethylcyclopentyl, ethyldimethylcyclopentyl, propylmethylcyclopentyl, propylethylcyclopentyl, di-propylcyclopentyl, propylethylmethylcyclopentyl, methylcyclohexyl, dimethylcyclohexyl, ethylcyclohexyl, propylcyclohexyl, ethylmethylcyclohexyl, trimethylcyclohexyl, diethylcyclohexyl, ethyldimethylcyclohexyl, propylmethylcyclohexyl, propylethylcyclohexyl, di-propylcyclohexyl, propylethylmethylcyclohexyl, methylcycloheptyl, dimethylcycloheptyl, ethylcycloheptyl, propylcycloheptyl, ethylmethylcycloheptyl, trimethylcycloheptyl, diethylcycloheptyl, ethyldimethylcycloheptyl, propylmethylcycloheptyl, propylethylcycloheptyl, di-propylcycloheptyl and propylethylmethylcycloheptyl; aryl groups, such as phenyl and naphthyl; alkylaryl groups, such as tolyl, xylyl, ethylphenyl, propylphenyl, ethylmethylphenyl, trimethylphenyl, butylphenyl, propylmethylphenyl, diethylphenyl, ethyldimethylphenyl, tetramethylphenyl, pentylphenyl, hexylphenyl, heptylphenyl, octylphenyl, nonylphenyl, decylphenyl, undecylphenyl and dodecylphenyl; and arylalkyl groups, such as benzyl, methylbenzyl, dimethylbenzyl, phenethyl, methylphenethyl and dimethylphenethyl. The above hydrocarbon groups include all possible isomers.

Specific examples of the zinc dithiophosphate usable in the present invention include zinc diisopropyldithiophosphate, zinc diisobutyldithiophosphate, zinc di-sec-butyldithiophosphate, zinc di-sec-pentylthiophosphate, zinc di-n-hexyldithiophosphate, zinc di-sec-hexyldithiophosphate, zinc di-octyldithiophosphate, zinc di-2-ethylhexyldithiophosphate, zinc di-n-decyldithiophosphate, zinc di-n-dodecyldithiophosphate, zinc diisotridecyldithiophosphate and mixtures thereof.

The amount of the zinc dithiophosphate added in the lubricant is not particularly restricted. The zinc dithiophosphate is preferably contained in an amount of 0.1% or less, more preferably in an amount of 0.06% or less, most preferably in a minimum effective amount, in terms of phosphorus element based on the total mass of the lubricant in order to produce a higher friction reducing effect. When the amount of the zinc dithiophosphate exceeds 0.1%, there arises a possibility that effect of the ashless friction modifier may be inhibited.

The zinc dithiophosphate can be prepared by any known method. For example, the zinc dithiophosphate may be prepared by reacting alcohols or phenols having the above $R^4$, $R^5$, $R^6$ and $R^7$ hydrocarbon groups with phosphorous pentasulfide to form dithiophosphoric acid, and then, neutralizing the thus-formed dithiophosphoric acid with zinc oxide. Herein, the molecular structure of zinc dithiophosphate differs according to the alcohol or phenol used as a raw material for the zinc dithiophosphate production.

The lubricant of the present invention may further include any other additive or additives, such as a metallic detergent, an antioxidant, a viscosity index improver, a friction modifier other than the above-mentioned fatty-ester friction modifier and/or the aliphatic-amine friction modifier, an ashless dispersant other than the above-mentioned polybutenyl succinimide and/or the derivative thereof, an anti-wear agent or extreme-pressure additive, a rust inhibitor, a non-ionic surfactant, a demulsifier, a metal deactivator and/or an anti-foaming agent, to be used in an internal combustion engine. These additives may be used alone or in the form of a mixture of two or more thereof so as to meet the lubricant performance required.

The metallic detergent can be any compound commonly used for a lubricant. Specific examples of the metallic detergent usable in the present invention include sulfonates, phenates and salicylates of alkali metals or alkali-earth metals; and mixtures of two or more thereof. Examples of the alkali metals include sodium (Na) and potassium (K), and examples of the alkali-earth metals include calcium (Ca) and magnesium (Mg). In the present invention, sodium and calcium sulfonates, sodium and calcium phenates, and sodium and calcium salicylates are suitably used. The total base number and amount of the metallic detergent can be selected in accordance with the lubricant performance required. The total base number of the metallic detergent is usually 0 to 500 mgKOH/g, preferably 150 to 400 mgKOH/g, as measured by perchloric acid method according to ISO 3771 "Determination of base number—Perchloric acid potentiometric titration method". The amount of the metallic detergent is usually 0.1 to 10% based on the total mass of the lubricant.

The antioxidant can be any compound commonly used for a lubricant. Specific examples of the antioxidant usable in the present invention include: phenolic antioxidants, such as 4,4'-methylenebis(2,6-di-tert-butylphenol) and octadecyl-3-(3,5-di-tert-butyl-4-hydroxyphenyl)propionate; amino antioxidants, such as phenyl-α-naphthylamine, alkylphenyl-α-naphthylamine and alkyldiphenylamine; and mixtures of two or more thereof. The amount of the antioxidant is usually 0.01 to 5% based on the total mass of the lubricant.

The viscosity index improver can be exemplified by: non-dispersion type viscosity index improvers, such as methacrylic acids, copolymers of methacrylic acids and hydrides thereof; and dispersion type viscosity index improvers, such as copolymers of methacrylates (including nitrogen compounds). There may be also used, as the viscosity index improver, copolymers of ethylene and α-olefins (such as propylene, 1-butene and 1-pentene) and hydrides thereof, polyisobutylenes and hydrides thereof, a hydrogenated copolymer of styrene and diene, a copolymer of styrene and maleic anhydride and polyalkylstyrenes. The molecular weight of the viscosity index improver needs to be selected in view of shear stability. For example, the number-average molecular weight of the viscosity index improver is in a range of 5,000 to 1,000,000, preferably 100,000 to 800,000 for dispersion or non-dispersion type polymethacrylates, in a range of preferably 800 to 5,000 for polyisobutylenes and hydrides thereof and in a range of 800 to 300,000, preferably 10,000 to 200,000 for ethylene/α-olefin copolymers and hydrides thereof. The above viscosity index improving compounds can be used alone or in the form of a mixture of two or more thereof. The amount of the viscosity index improver is preferably 0.1 to 40.0% based on the total mass of the lubricant.

The friction modifier other than the above-mentioned fatty-ester friction modifier and/or the aliphatic-amine friction modifier can be exemplified by ashless friction modifiers, such as boric acid esters, higher alcohols and aliphatic ethers, and metallic friction modifiers, such as molybdenum dithiophosphate, molybdenum dithiocarbamate and molybdenum disulfide.

The ashless dispersant other than the above-mentioned polybutenyl succinimide and/or the derivative thereof can be exemplified by polybutenylbenzylamines and polybutenylamines each having polybutenyl groups of number-average molecular weight of 900 to 3,500, polybutenyl succinimides having polybutenyl groups of number-average molecular weight of less than 900 and derivatives thereof.

The anti-friction agent or extreme-pressure additive can be exemplified by disulfides, sulfurized fats and oils, olefin sulfides, phosphate esters having one to three $C_2$–$C_{20}$ hydrocarbon groups, thiophosphate esters, phosphite esters, thiophosphite esters and amine salts of these esters.

The rust inhibitor can be exemplified by alkylbenzene sulfonates, dinonylnaphthalene sulfonates, esters of alkenylsuccinic acids and esters of polyalcohols.

The nonionic surfactant and the demulsifier can be exemplified by noionic polyalkylene glycol surfactants, such as polyoxyethylene alkylethers, polyoxyethylene alkylphenyleters and polyoxyethylene alkylnaphthyleters.

The metal deactivator can be exemplified by imidazoline compounds, pyrimidine derivatives, thiazole and benzotriazole.

The anti-foaming agent can be exemplified by silicones, fluorosilicones and fluoroalkylethers.

Each of the friction modifier other than the fatty-ester friction modifier and/or the aliphatic-amine friction modifier, the ashless dispersant other than the polybutenyl succinimide and/or the derivative thereof, the anti-wear agent or extreme-pressure additive, the rust inhibitor and the demulsifier is usually contained in an amount of 0.01 to 5% based on the total mass of the lubricant, and the metal deactivator is contained in an amount of 0.0005 to 1% based on the total mass of the lubricant.

With the above-described structure, the sliding mechanism of the present invention allows the first and second sliding members to slide relative each other via the lubricant with the friction between the sliding surfaces being less than that of the earlier technology. Accordingly, the sliding mechanism of the present invention can attain excellent low-friction characteristics and high abrasion resistance to be fit for a variety of uses, especially useful for an internal combustion engine. For example, the first sliding member can be a coating of DLC material applied to a steel base of a disk-shaped shim or applied to a steel end face of a lifter, and the second sliding member can be a cam lobe. The sliding mechanism of the present invention can be also used as a sliding gear of an industrial machine.

The present invention will be described in more detail by reference to the following examples. However, it should be noted that the following examples are only illustrative and not intended to limit the invention thereto.

EXAMPLES 1 To 14 AND COMPARATIVE EXAMPLES 1 to 5

(1) Assembly of Cam Units

In Examples 1 to 1 to 14 and Comparative Examples 1 to 5, cam units were assembled. The cam units were designed by simulating a typical camshaft of a vehicle engine, and each cam unit comprised one cam lobe and one cam follower having a disk-shaped shim at an end face thereof disposed slidably relative to a cam nose of the cam lobe via a lubricant. The cam lobes, the shims and the lubricants used in Examples 1 to 1 to 14 and Comparative Examples 1 to 5 were made as follows and combined as shown in TABLE 1.

(1-1) Production of Cam Lobes

The cam lobes of Examples 1 to 1 to 14 and Comparative Examples 1 to 5 were produced by cutting and grinding the following iron-based materials into a uniform cam profile and lapping them with lapping tapes in such a manner as to form their respective cam noses with different surface roughnesses (Ra=0.2 $\mu$m) as shown in TABLE 1.

(Iron-Based Materials)

Low-alloy chilled cast iron: A material used for a camshaft in a mass-produced, four-cylinder engine.

Carburized SCM420: A cast of SCM420, subjected to carburization at 900° C. for 1 hour, hardening with a quenching oil, heating to 200° C., and then, low-temperature hardening by air cooling.

Heat-treated S40C: A cast of S40C, subjected to heating in a vacuum furnace at 880° C. for 1 hour, hardening by water cooling, heating to 200° C., and then, low-temperature hardening by air-cooling.

Tempered S40C: A cast of S40C, subjected to tempering.

(1-2) Production of Shims

The shims were produced by subjecting disk-shaped shim bases (made of SCM420) to carburization and low-temperature hardening, grinding surfaces of the shim bases by a lapping tape in such a manner as to form the base surfaces with a surface roughness Ra of 0.03 $\mu$m, applying various coating materials on the shim base surfaces by chemical vapor deposition (CVD) or physical vapor deposition (PVD), and then, lapping the thus-formed coatings by lapping tapes in such a manner as to form the coatings with different surface thicknesses (Ra=0.1 $\mu$m) as shown in TABLE 1. The coating materials used were DLC materials, such as a-C and a-C:H, TiN and CrN. The coatings of DLC materials were formed by CVD, and the coatings of TiN and CrN were formed by PVD.

(1-3) Preparation of Lubricants

Lubricants A to I were prepared by mixing base oils with additives including ashless fatty-ester friction modifiers and/or aliphatic-amine friction modifiers, respectively. The compositions and properties of the thus-prepared Lubricants A to I are shown in TABLE 2. In TABLE 2, the amount of base oil is indicated based on the total mass of the base oil, and the amount of additive is indicated based on the total mass of the lubricant.

(2) Abrasion Test on Cam Units

The thus-obtained cam units were subjected to abrasion test under the following test conditions. The test results are shown in TABLE 1.

(Test Condition)

Maximum pressure: 700 MPa/Hz

Cam rotation speed: 600 rpm

Lubrication method: drop lubrication

Lubricant temperature: 100° C.

Test time: 60 minutes

It is clear from TABLE 1 that the cam units of Examples 1 to 14 had excellent low-friction characteristics, with friction coefficients thereof reduced by about 30 to 50% as compared with the cam unit of Comparative Example 1.

More specifically, the cam units of Examples 1 to 9, which conformed to the above-described desirable requirements for the sliding mechanism of the present invention, had lower friction coefficients than those of Examples 10 to 14 without any deteriorations in the cam noses and the shim coatings after the abrasion test. The cam units of examples 10 to 14 had the following undesirable propensities, although their low-friction characteristics were satisfactory. That is, the cam lobe in Example 10 was susceptible to abrasion because of its lower surface hardness. In Example 11, the shim coating tended to be scuffed in a streak manner because of its lower surface hardness Hv and a smaller thickness t. In Example 12, the shim coating tended to flake off because of its a higher surface hardness Hv and a larger thickness t. In Example 13, the cam lobe was susceptible to abrasion because of its a higher surface roughness Ra. In Example 14, the cam lobe was susceptible to abrasion because the shim coating had a higher surface roughness Ra.

It is also proved that the friction reducing effect of the lubricant becomes more pronounced as the amount of zinc dithiophosphate is decreased, upon the comparison of the cam units of Examples 1, 2 and 7.

On the other hand, the cam unit of Comparative Example 1 comprised the cam lobe of low-alloy chilled cast iron, the shim of carburized SCM420 and the lubricant H with no coating of DLC material formed on the shim and no ashless fatty-ester friction modifier and/or ashless aliphatic-amine friction modifier contained in the lubricant H, which corresponded to a commonly used combination for a gasoline engine. As a result, the cam unit of Comparative Example 1 deteriorated in low-friction characteristics with its friction coefficient being higher than 0.1. It is estimated that such a deterioration in low-friction characteristics occurred because of reaction films being formed predominantly of zinc dithiophosphate (ZnDTP) on the sliding surfaces.

The cam unit of Comparative Example 2 was structurally the same as that of Comparative Example 1, except that the lubricant E was used in place of the lubricant H. The lubricant E contained an effective amount of ashless fatty-ester friction modifier, thereby producing a little friction reducing effect. However, the cam unit of Comparative Example 2 had a relatively high friction coefficient of about 0.1. It is also thought that such a deterioration in the low-friction characteristics occurred because of reaction films being formed predominantly of ZnDTP on the sliding surfaces.

The cam unit of Comparative Example 3 was structurally the same as that of Example 4, except that the lubricant I was used in place of the lubricant D. The lubricant I contained an effective amount of organomolybdenum compound, which provides a good friction reducing effect in combination with a steel material. The cam unit of Comparative Example 3, however, had a friction coefficient of nearly 0.1. It is thought that, in Comparative Example 3, the low-friction characteristics of the cam unit were deteriorated because of molybdenum disulfide films not being formed to reduce friction between the sliding surfaces.

The cam unit of Comparative Example 4 comprised the shim coating of TiN and the lubricant E containing an ashless fatty-ester friction modifier. Accordingly, the friction coefficient of the cam unit was slightly decreased in Comparative Example 4, but stands at nearly 0.1. The cam unit of Comparative Example 5 was structurally the same as that of Comparative Example 4, except that the shim coating was formed of CrN. There was little difference between the friction coefficients of the cam units of Comparative Examples 4 and 5.

As described above, the sliding mechanism of the present invention can attain excellent low-friction characteristics and high abrasion resistance by the combination of the first sliding member of DLC material, the second sliding member of iron-based material and the lubricant containing at least one of ashless fatty-ester and aliphatic-amine friction modifiers. Therefore, the sliding mechanism of the present invention, when used in an internal combustion engine, can reduce friction loss at e.g. a valve lifter dramatically and therefore provide more improvements in vehicle fuel efficiency than ever before.

The entire contents of Japanese Patent Application No. 2002-045576 (filed on Feb. 22, 2002) are herein incorporated by reference.

Although the present invention has been described with reference to specific embodiments of the invention, the invention is not limited to the above-described embodiments. Various modification and variation of the embodiments described above will occur to those skilled in the art in light of the above teaching. The scope of the invention is defined with reference to the following claims.

TABLE 1

| | Shim base | | Shim coating | | | |
|---|---|---|---|---|---|---|
| | Material | Ra (μm) | Material | t (μm) | Ra (μm) | Hv |
| Example 1 | SCM420 | 0.03 | a-C | 1.1 | 0.03 | 1,850 |
| Example 2 | SCM420 | 0.03 | a-C | 1.5 | 0.03 | 1,850 |
| Example 3 | SCM420 | 0.03 | a-C | 1.4 | 0.03 | 1,850 |
| Example 4 | SCM420 | 0.03 | a-C | 0.8 | 0.03 | 1,850 |
| Example 5 | SCM420 | 0.03 | a-C | 0.7 | 0.02 | 1,250 |
| Example 6 | SCM420 | 0.03 | a-C | 2.0 | 0.02 | 1,000 |
| Example 7 | SCM420 | 0.03 | a-C | 1.1 | 0.03 | 1,850 |
| Example 8 | SCM420 | 0.03 | a-C | 0.9 | 0.05 | 1,850 |
| Example 9 | SCM420 | 0.03 | a-C | 0.3 | 0.04 | 3,500 |
| Example 10 | SCM420 | 0.03 | a-C | 1.1 | 0.04 | 2,000 |
| Example 11 | SCM420 | 0.03 | a-C:H | 0.2 | 0.03 | 950 |
| Example 12 | SCM420 | 0.03 | a-C | 2.1 | 0.05 | 3,600 |
| Example 13 | SCM420 | 0.03 | a-C | 1.1 | 0.04 | 1,100 |
| Example 14 | SCM420 | 0.03 | a-C | 1.2 | 0.11 | 1,100 |
| Comparative Example 1 | SCM420 | 0.03 | (none) | — | 0.03 | — |
| Comparative Example 2 | SCM420 | 0.03 | (none) | — | 0.03 | — |
| Comparative Example 3 | SCM420 | 0.03 | a-C | 1.2 | 0.03 | 1,850 |
| Comparative Example 4 | SCM420 | 0.03 | TiN | 2.5 | 0.04 | 2,300 |
| Comparative Example 5 | SCM420 | 0.03 | CrN | 2.6 | 0.03 | 1,700 |

| | Cam Lobe | | | | |
|---|---|---|---|---|---|
| | Material | Ra (μm) | HRC | Lubricant | Friction Coefficient |
| Example 1 | Low-alloy chilled cast iron | 0.05 | 51 | A | 0.060 |
| Example 2 | Low-alloy chilled cast iron | 0.05 | 51 | B | 0.067 |
| Example 3 | Low-alloy chilled cast iron | 0.05 | 51 | C | 0.066 |
| Example 4 | Low-alloy chilled cast iron | 0.05 | 51 | D | 0.069 |
| Example 5 | Carburized SCM420 | 0.04 | 59 | A | 0.068 |
| Example 6 | Heat-treated S40C | 0.03 | 45 | B | 0.066 |
| Example 7 | Low-alloy chilled cast iron | 0.10 | 51 | E | 0.073 |
| Example 8 | Low-alloy chilled cast iron | 0.05 | 51 | F | 0.070 |
| Example 9 | Low-alloy chilled cast iron | 0.05 | 51 | G | 0.068 |
| Example 10 | Tempered S40C | 0.03 | 42 | B | 0.071 |
| Example 11 | Low-alloy chilled cast iron | 0.05 | 51 | B | 0.079 |
| Example 12 | Low-alloy chilled cast iron | 0.05 | 51 | C | 0.080 |
| Example 13 | Low-alloy chilled cast iron | 0.20 | 51 | E | 0.069 |
| Example 14 | Low-alloy chilled cast iron | 0.05 | 51 | E | 0.067 |
| Comparative Example 1 | Low-alloy chilled cast iron | 0.10 | 51 | H | 0.12 |
| Comparative Example 2 | Low-alloy chilled cast iron | 0.05 | 51 | E | 0.10 |
| Comparative Example 3 | Low-alloy chilled cast iron | 0.05 | 51 | I | 0.095 |
| Comparative Example 4 | Low-alloy chilled cast iron | 0.05 | 51 | E | 0.092 |
| Comparative Example 5 | Low-alloy chilled cast iron | 0.05 | 51 | E | 0.088 |

TABLE 2

| Lubricant | A | B | C | D | E | F | G | H | I |
|---|---|---|---|---|---|---|---|---|---|
| Base oil | | | | | | | | | |
| Mineral oil[1)] (mass %) | 100 | 100 | — | 100 | 100 | 100 | 100 | 100 | 100 |
| Synthetic oil[2)] (mass %) | — | — | 100 | — | — | — | — | — | — |
| Additives | | | | | | | | | |
| Friction modifier | | | | | | | | | |
| Fatty-ester[3)] (mass %) | 1.0 | 1.0 | 1.0 | — | 1.0 | 1.0 | 0.2 | — | — |
| Aliphatic amine[4)] (mass %) | — | — | — | 1.0 | — | 0.5 | — | — | — |
| Organomolybdenum compound[5)] (mass %) | — | — | — | — | — | — | — | — | 1.1 |
| Ashless dispersant[6)] (mass %) | 5.0 | 5.0 | 5.0 | 5.0 | 5.0 | 5.0 | 5.0 | 5.0 | 5.0 |
| Antioxidant[7)] (mass % in terms of phosphorus) | — | 0.047 | 0.047 | 0.047 | 0.094 | 0.094 | 0.047 | 0.094 | 0.094 |
| Metallic detergent[8)] (mass %) | 0.5 | 0.5 | 0.5 | 0.5 | 0.5 | 0.5 | 0.5 | 0.5 | 0.5 |
| Metallic detergent[9)] (mass %) | 0.9 | 0.9 | 0.9 | 0.9 | 0.9 | 0.9 | 0.9 | 0.9 | 0.9 |
| Others[10)] (mass %) | 7.0 | 7.0 | 7.0 | 7.0 | 7.0 | 7.0 | 7.0 | 7.0 | 7.0 |
| Properties | | | | | | | | | |
| Kinematic viscosity at 100° C. ($mm^2/s$) | 10.3 | 10.2 | 10.0 | 10.2 | 10.3 | 10.3 | 10.3 | 10.3 | 10.2 |
| Total base number[11)] (mgKOH/g) | 6.2 | 6.2 | 6.2 | 6.2 | 6.5 | 6.5 | 6.5 | 6.5 | 7.5 |
| Total base number[12)] (mgKOH/g) | 4.5 | 4.5 | 4.5 | 4.5 | 5.2 | 5.2 | 5.2 | 5.2 | 6.0 |

[Remarks]

[1)]Hydrocracked mineral oil (kinematic viscosity at 100° C.: 5.0 $mm^2/s$, viscosity index: 120, aromatic content: 5.5%)

[2)]1-Decene oligomer hydride (kinematic viscosity at 100° C.: 3.9 $mm^2/s$, viscosity index: 124, aromatic content: 0.0%)

[3)]Glycerol monolate

[4)]N,N-dipolyoxyethylene-N-oleylamine

[5)]Molybdenum dithiocarbamate (molybdenum content: 4.1%)

[6)]Polybutenyl succinimide (nitrogen content: 1.2%)

[7)]Zinc dialkyldithiophosphate (zinc content: 9.3%, phosphrous content: 8.5%, alkyl group: secondary butyl or hexyl group)

[8)]Calcium sulfonate (total base number: 300 mgKOH/g, calcium content: 12.0%)

[9)]Calcium phenate (total base number: 255 mgKOH/g, calcium content: 9.2%)

[10)]Including viscosity index improver, antioxidant, rust inhibitor, demulsifier, nonionic surfactanct, metal deactivator and anti-foaming agent

[11)]Measured by perchloric acid method (according to ISO 3771)

[12)]Measured by hydrochloric method (according to ISO 3771)

What is claimed is:

1. A low-friction sliding mechanism, comprising:

first and second sliding members slidable relative to each other at sliding surfaces thereof, the first sliding member being made of a diamond-like carbon material, the second sliding member being made of an iron-based material; and a lubricant applied to the sliding surfaces of the first and second sliding members and comprising at least one of an ashless fatty-ester friction modifier and an ashless aliphatic-amine friction modifier.

2. The low-friction sliding mechanism according to claim 1, wherein the diamond-like carbon material is a material selected from the group consisting of hydrogen-free amorphous carbon, hydrogen-containing amorphous carbon and metal carbide, and the iron-based material is at least one material selected from the group consisting of low-alloy chilled cast iron, carburized steel and heat-treated carbon steel.

3. The low-friction sliding mechanism according to claim 2, wherein the diamond-like carbon material is hydrogen-free amorphous carbon.

4. The low-friction sliding mechanism according to claim 1, wherein each of the first and second sliding members has at the sliding surface thereof an arithmetic mean surface roughness of 0.1 $\mu$m or less.

5. The low-friction sliding mechanism according to claim 1, wherein the first sliding member has a micro Vickers hardness of 1,000 to 3,500 with a 1 kg load applied at the sliding surface thereof and a thickness of 0.3 to 2.0 $\mu$m, and the second sliding member has a Rockwell hardness of 45 to 60 on C scale at the sliding surface thereof.

6. The low-friction sliding mechanism according to claim 1, for use in an internal combustion engine.

7. The low-friction sliding mechanism according to claim 6, wherein the first sliding member is a coating of the diamond-like carbon material on either of a steel base portion of a shim and a steel end face of a lifter, and the second sliding member is a cam lobe.

8. The low-friction sliding mechanism according to claim 1, wherein the fatty-ester friction modifier and the aliphatic-amine friction modifier are a fatty acid ester and an aliphatic amine having $C_6$–$C_{30}$ straight or branched hydrocarbon chains, respectively, and said at least one of the fatty-ester friction modifier and the aliphatic-amine friction modifier is contained in an amount of 0.05 to 3.0% by mass based on a total mass of the lubricant.

9. The low-friction sliding mechanism according to claim 1, wherein the lubricant further comprises polybutenyl succinimide and/or derivative thereof in an amount of 0.1 to 15% by mass based on a total mass of the lubricant.

10. The low-friction sliding mechanism according to claim 1, wherein the lubricant further comprises zinc dithiophosphate in an amount of 0.1% or less by mass in terms of phosphorus element based on a total mass of the lubricant.

* * * * *